US005548938A

United States Patent [19]

Scheiwiller

[11] Patent Number: 5,548,938

[45] Date of Patent: Aug. 27, 1996

[54] SET OF MASONRY BLOCKS

[76] Inventor: René Scheiwiller, Postfach 266, 6052 Hergiswil, Switzerland

[21] Appl. No.: 196,172

[22] PCT Filed: Jun. 18, 1993

[86] PCT No.: PCT/EP93/01573

§ 371 Date: Feb. 14, 1994

§ 102(e) Date: Feb. 14, 1994

[87] PCT Pub. No.: WO94/00648

PCT Pub. Date: Jan. 6, 1994

[30] Foreign Application Priority Data

Jun. 19, 1992 [DE] Germany ..... 42 20 034.2

[51] Int. Cl.[6] ..... E04B 5/04; E04C 2/04

[52] U.S. Cl. ..... 52/604; 52/605; 52/606; 52/592.1; 405/286

[58] Field of Search ..... 52/596, 604, 605, 52/606, 607, 608, 259, 592.1, 102; 405/286, 284; 47/33; 404/7

[56] References Cited

U.S. PATENT DOCUMENTS

| | | | |
|---|---|---|---|
| 3,855,752 | 12/1974 | Aylon | 52/605 |
| 4,107,894 | 8/1978 | Mullins . | |
| 4,884,920 | 12/1989 | Perazzi | 52/608 X |
| 5,003,746 | 4/1991 | Wilston . | |
| 5,154,032 | 10/1992 | Ritter . | |

FOREIGN PATENT DOCUMENTS

| | | |
|---|---|---|
| 663336 | 9/1965 | Belgium . |
| 0385950A2 | 9/1990 | European Pat. Off. . |
| 2202212 | 5/1974 | France . |
| 2657638 | 8/1991 | France . |
| 2435139 | 2/1975 | Germany . |
| 7725725 | 11/1978 | Germany . |
| 564979 | 2/1946 | United Kingdom . |

OTHER PUBLICATIONS

GISOTON–Baustoffwerke Gebhart & Söhne KG, Aichstetten; Shuttering blocks for load–bearing wall and partition wall systems.

*Primary Examiner*—Kien T. Nguyen
*Attorney, Agent, or Firm*—Spencer & Frank

[57] ABSTRACT

A set of masonry blocks comprises a rectangular basic block having a basic length dimension L, a width B and a height H and including lateral end sides comprising a joining portion including a recess which defines a portion of a first cylinder, and being adapted to contact adjacent masonry blocks at matching joining portions thereof. The set further includes rectangular end blocks one lateral end side of which comprises a joining portion identical to the joining portion of the basic block, and another lateral end side of which comprises a closed masonry-wall termination surface. The rectangular end blocks include a three quarter end block having a length equal to three quarters of L, and a one quarter end block having a length equal to one quarter of L, The set further includes a hinge block having a length equal to L plus an extension amount X, the hinge block further having a cylindrical portion attached to a rectilinear portion which includes a joining portion identical to the joining portion of the basic block, the cylindrical portion including an outer contour defining a portion of a second cylinder having a second radius R equal to the first radius and adapted to mate with a corresponding recess of an adjacent joining portion, where 2R=B+2X, the outer contour of the cylindrical portion thereby extending beyond the width B of each masonry block on each side thereof by an amount equal to the extension amount X.

10 Claims, 9 Drawing Sheets

H
L+x
B+2x
B
x
L
$\frac{1}{4}$L
$\frac{1}{2}$L
R
α
29
22
31
32
33
21
5
30
14"
14'
32'
A
$b_1$
$b_4$
6

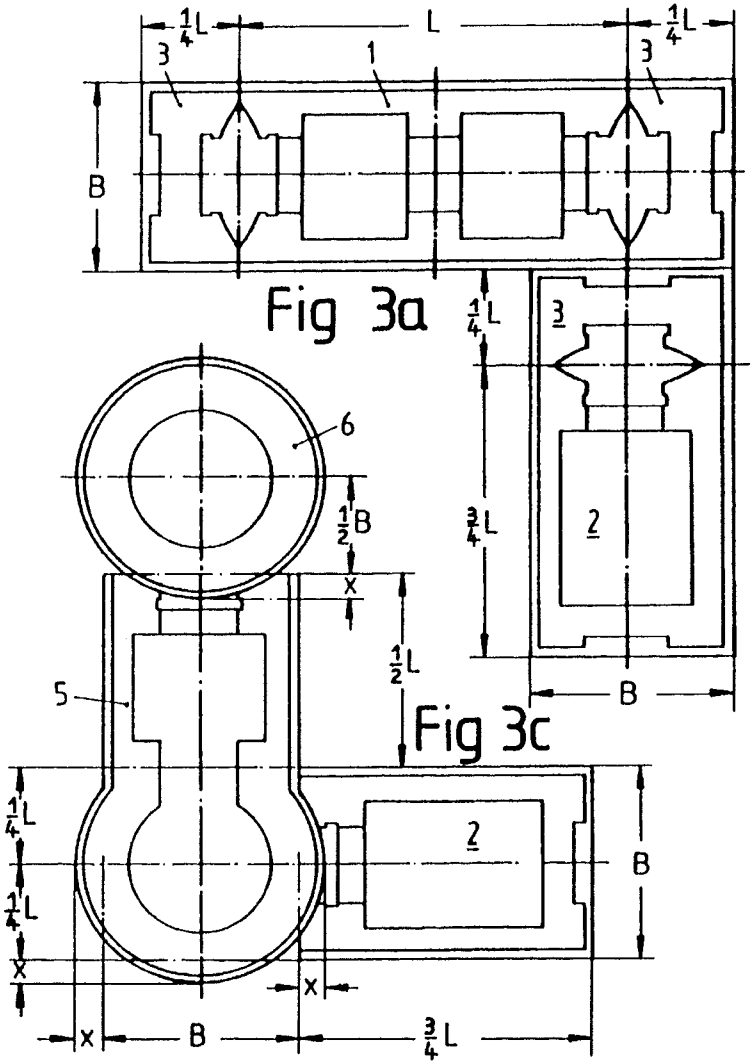
Fig 3a
Fig 3c
L
B
1
2
3
5
6
x
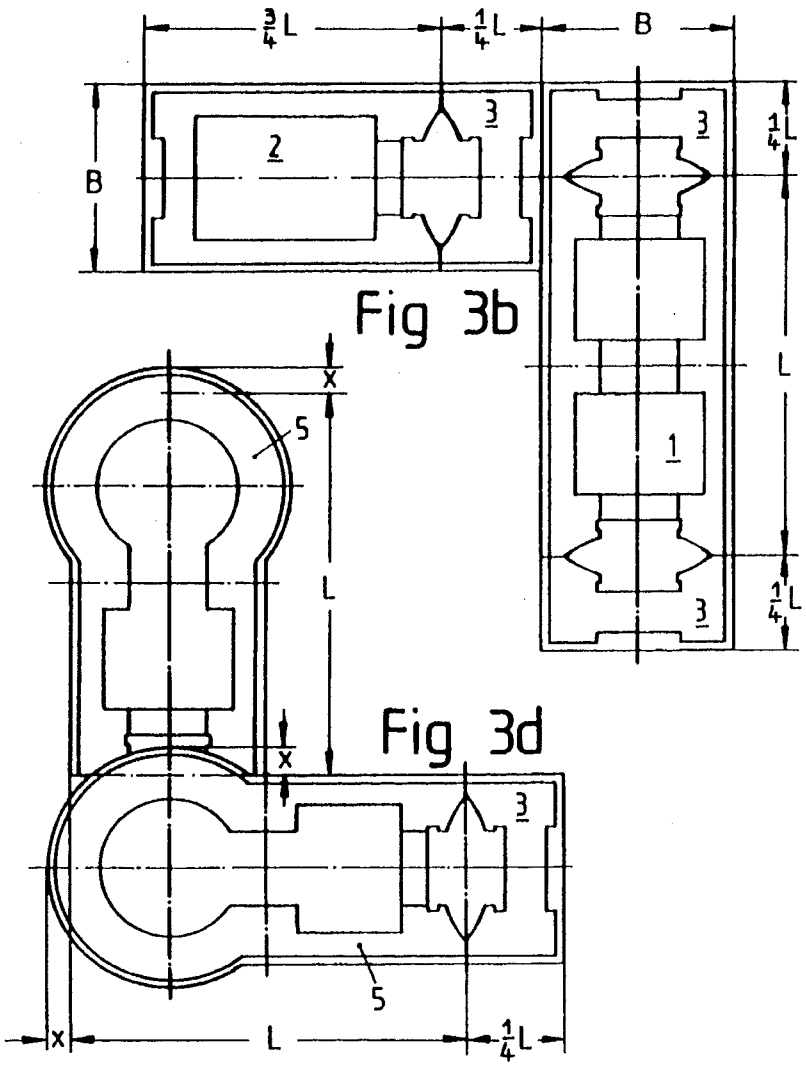
Fig 3b
Fig 3d
L
B
1
2
3
5
x

SET OF MASONRY BLOCKS

The invention relates to a set of masonry blocks adapted to be disposed adjacent one another.

BACKGROUND OF THE INVENTION

A set of masonry blocks of the above type is disclosed in German Offenlegungsschrift 24 35 139. The German Utility Model GM 77 25 725 shows a similar masonry block.

Masonry blocks of this type are also designated as shuttering blocks, hollow blocks, heat-insulating blocks or the like. The inner chambers are generally used for insulation and are filled, if appropriate, with an insulating means. On their two lateral end sides, the known masonry blocks have diversely shaped grooves or cutouts in order to obtain, by means of corresponding protrusions on the neighboring connection block, a positively locking connection. According to FIG. 8 of the abovementioned utility model, each end side may have in each case a trapezoidal groove on one side and a trapezoidal protrusion on the other side. The opposite end side of the masonry block then has the corresponding, complementary configurations.

The masonry block according to the abovementioned Offenlegungsschrift is designed symmetrically with respect to its longitudinal-symmetry plane and its transverse-symmetry plane. In order to obtain a positively locking connection between two neighboring blocks, additional connecting blocks or filler blocks are provided which engage in the manner of a dovetail into the respective cutouts on the end sides of the masonry blocks. In this arrangement, each masonry block also has, in its region which is central in plan view, a corresponding cutout which receives such a connecting block. As a result, a positively locking connection is also achieved with respect to the course located immediately above or beneath. This applies, in particular, for producing a half offset of the respective masonry-block courses. Finally, the last-mentioned masonry block also exhibits a positively locking connection, via the connecting block, to neighboring block courses, in the event where a plurality of block walls are arranged one beside the other. The corresponding cutouts for the connecting blocks can be broken off at predetermined breaking points.

The described masonry blocks, hollow blocks or shuttering blocks for producing load-bearing walls and partition walls are constructed in a specific module dimension, for the most part rectangular basic blocks being provided in the module dimension.

So-called corner blocks have also occasionally been disclosed, for example as shown in Swiss Patent 227 752, FIG. 3.

A catalog for the company GISOTON-Baustoffwerke Gebhart & Söhne KG, D-7974 Aichstetten, discloses shuttering blocks for load-bearing wall and partition wall systems which are constructed in a module system on the basis of a set of structural elements. In addition to a normal block there is provided a separating block which has the same dimensions and can be separated in the middle via predetermined breaking points. Furthermore, a corner block for a corner connection and a mitered element for producing angled connections, the angle being fixed at 135°, are provided. Each block has chambers, if appropriate for receiving heat-insulating material such as Styropor or the like.

In order also to be able to produce angled arrangements with different connection angles, masonry blocks are known which have a type of hinge (EP 0 385 950 A2). Such a hinge block has, on its first end surface, a circular-cylindrical connection part which interacts, on the appertaining connection surface of the neighboring block, with a hollow-cylindrical counter-surface. Such hinge blocks may likewise have chambers which, in the case of normal masonry blocks or shuttering blocks, may be empty or filled.

All known masonry-block or shuttering-block systems with or without curve configuration have the disadvantage that these comprise individual components which, as a whole, do not have the necessary flexibility for any desired configuration. Thus, taken individually, the vast range of masonry-block systems has particular properties and exhibits particular advantages. A combination of such properties and advantages has, however, not been provided up until now.

SUMMARY OF THE INVENTION

It is an object of the invention to provide a set of masonry blocks which combines a series of advantages of the known systems and is, as a whole, based on a standardized and well-thought-out concept and can be used diversely.

According to the invention, this object is achieved by a set of masonry blocks comprising a rectangular basic block having a basic length dimension L, a width B and a height H and including lateral end sides comprising a joining portion extending over the entire height H of the basic block, the joining portion including a recess defining a portion of a first cylinder having a first radius, the joining portion being adapted to contact adjacent masonry blocks at matching joining portions thereof. The set further includes rectangular end blocks having first and second lateral end sides, the first lateral end side comprising a joining portion having a structure identical to the joining portion of the basic block, the second lateral end side comprising a closed masonry-wall termination surface. The rectangular end blocks include a three quarter end block having a length equal to three quarters of the basic length dimension L, and a one quarter end block having a length equal to one quarter of the basic length dimension L. The set further includes a hinge block having a length equal to the basic length dimension L plus an extension amount X, the hinge block further having a rectilinear portion and a cylindrical portion attached to the rectilinear portion, the rectilinear portion including a joining portion having a structure identical to the joining portion of the basic block, the cylindrical portion including an outer contour defining a portion of a second cylinder having a second radius R equal to the first radius and adapted to mate with a corresponding recess of an adjacent joining portion in an assembled state where the first and second cylinders have corresponding center points. The respective dimensions are such that $2R=B+2X$, the outer contour of the cylindrical portion thereby extending beyond the width B of each masonry block on each side thereof by an amount equal to the extension amount X.

The set of masonry blocks according to the invention combines a multiplicity of known properties and provides an all-inclusive concept which permits extremely versatile use for a vast range of application purposes. The system can be used for both normal load-bearing and partition walls, for a shuttering-block system, and for special purposes, for example as a slope block. The set of masonry blocks according to the invention is fundamentally based on an individual-block system which is constructed in a module system using blocks which are positioned, by means of positively locking connections, in an offset manner as well as one behind the other and one above the other. In this arrangement, a "normal block" or "basic block" is assigned, in a specific module dimension "L", a so-called "¾-end block" and a "¼-end block", which are ¾ and ¼, respectively, of the length L of the normal block and serve to vary the transition areas in the end region of a masonry wall and to produce a masonry block offset portion in the case of a rectilinear configuration and in the case of a corner configuration. The width "B" of the blocks is likewise of a module dimension and is half the length of the basic block.

This triple combination is supplemented by a single-part hinge block and a round block, which can be integrated into the masonry-wall assembly. A "½-block" is further provided, by way of supplement, for special purposes. The system is finally supplemented by covering blocks or coping stones for the vast range of applications.

BRIEF DESCRIPTION OF THE DRAWINGS

Further details and advantages of the invention are explained in more detail in the following description of exemplary embodiments and can be seen in the drawings, in which:

FIGS. 3*a* and 3*b* show two corner configurations adapted to be mounted one above the other using the 1/1-basic block of the end blocks shown in FIGS. 1*a*–1*c;*

FIGS. 3*c* and 3*d* show two corner configurations adapted to be mounted one above the other using the hinge 1/1-block of FIG. 2*a* and the round block of FIG. 2*d;*

DETAILED DESCRIPTION OF THE PREFERRED EMBODIMENTS

In the exemplary embodiment, the set of masonry blocks comprises basic parts according to FIG. 1 and—if curved shapes are desired—the additional structural elements according to FIG. 2.

Figures 1A, 1B, 1C, 1D, 1E:
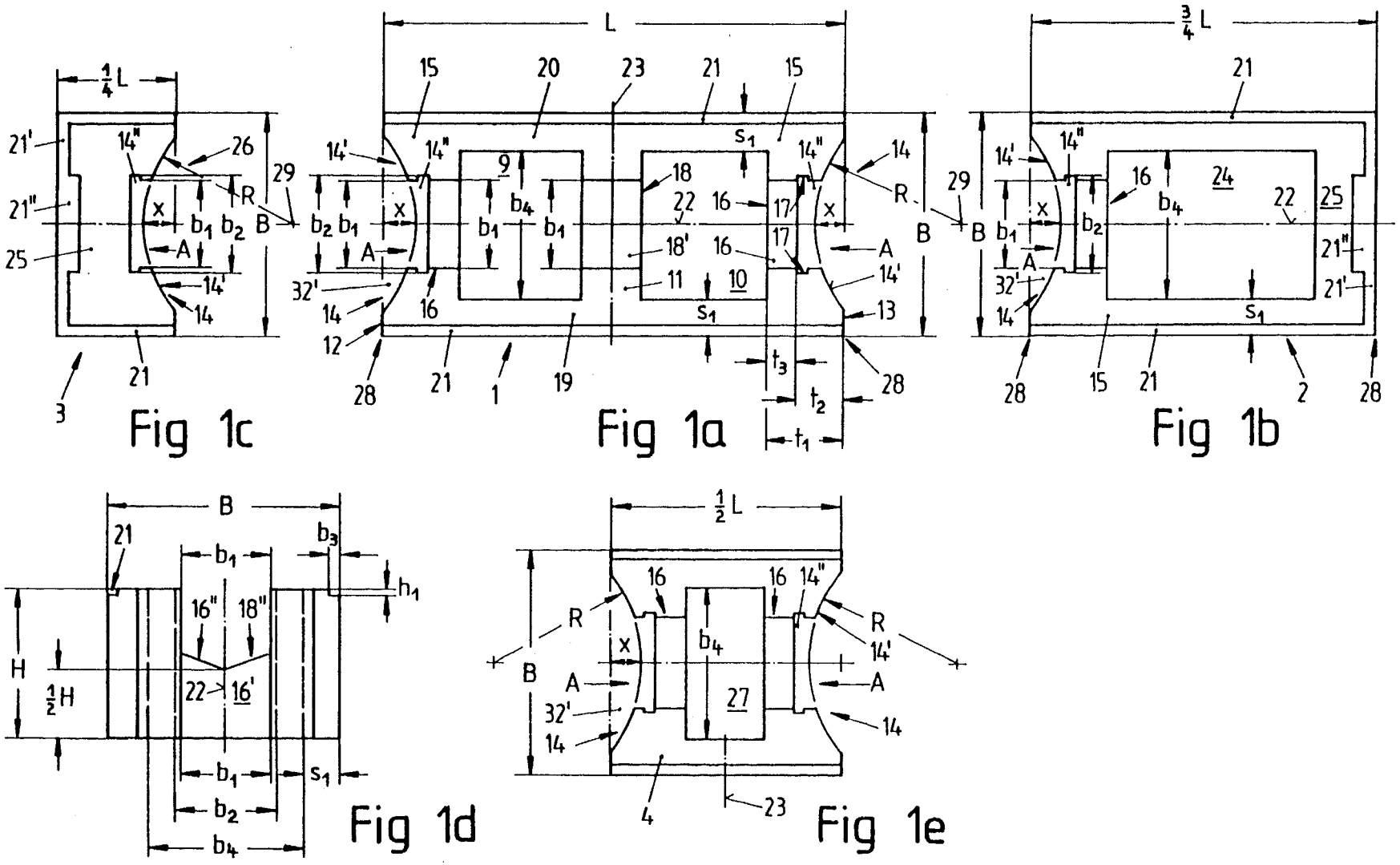
FIG. 1*a* shows a top plan view of a 1/1-basic block.
FIG. 1*b* shows a top plan view of a ¾-end block.
FIG. 1*c* shows a top plan view of a ¼-end block.
FIG. 1*d* shows a side elevational view of the blocks in FIGS. 1*a*–1*c* as seen in direction A.
FIG. 1*e* shows a top plan view of a half-block.

FIG. 1*a* shows the 1/1-basic block 1 which has a length L, a width B and a height H in a .module dimension of, for example, L: B: H=60: 30: 15 cm. The height of the block can also be seen from the end view A in FIG. 1*d*. The 1/1-basic block 1 is supplemented with or assigned the ¾-end block 2 represented according to FIG. 1*b* and having the length ¾ L, the ¼-end block 3 represented in FIG. 1*c* and having the length ¼ L and the ½-middle block 4 represented in FIG. 1*e* and having the length ½ L. The two end blocks 2, 3 and the middle block 4 have the same width B and the same height H, the width B of the blocks 1 to 4 corresponding to half the length L of the basic block 1 (B=½ L) . The set of masonry blocks is supplemented by the hinge block 5 represented in FIG. 2, the round block 6 and the covering blocks 7 and 8 represented in FIG. 7.

The 1/1-basic block 1 represented in FIG. 1 has two chambers 9, 10 which are located one beside the other and are separated by a separating web 11. In accordance with the perspective representation in FIGS. 4*a* and 4*b* in conjunction with FIG. 1*a*, the basic block has, on its two lateral end sides 12, 13, in plan view, a joining portion including in each case an arcuate and U-shaped cutout 14, the two cutouts together extending over a depth $t_2$ into the end-side masonry structure 15. At this point, the masonry structure 15 has a depth $t_1 \approx 40$ mm. The depth $t_2$ is approximately ½ $t_1$. The arcuate portion 14' of the cutout 14 forms, with the end side 12, 13, a circle segment 32' having a chord height "X", i.e. the portion 14' extends over a depth "X" having an arc or cylinder radius R, where R=B/2+X. This is adjoined by the U-shaped cutout region 14".

Figure 4A:
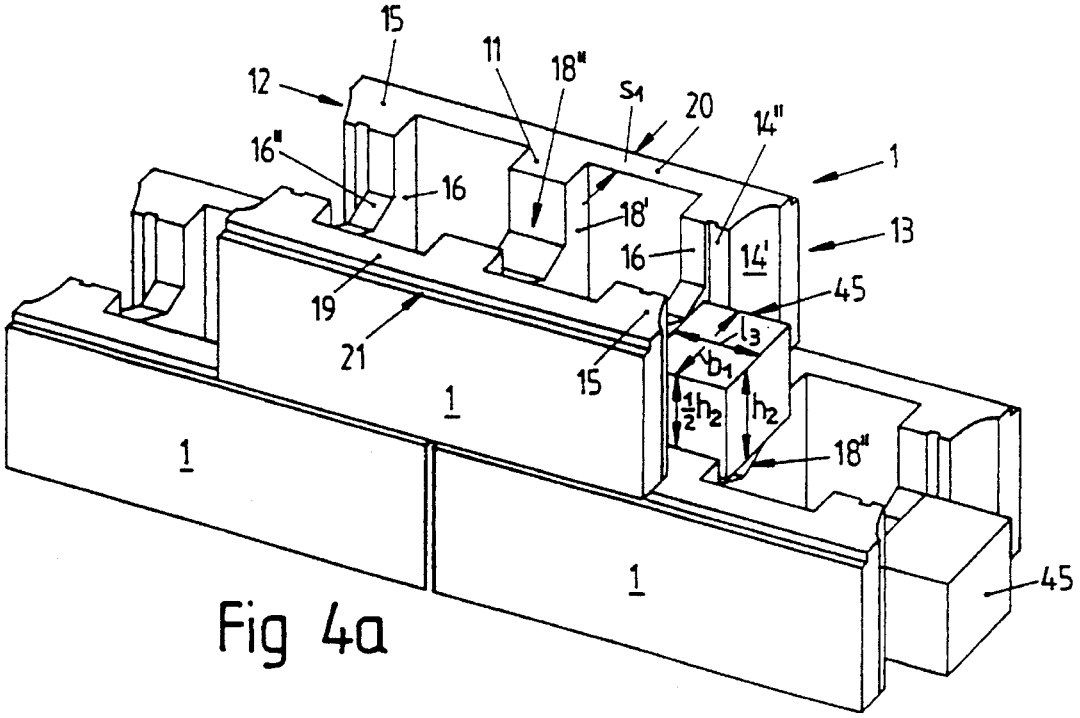
FIG. 4*a* shows a perspective view of three assembled basic blocks.
Figure 4B:
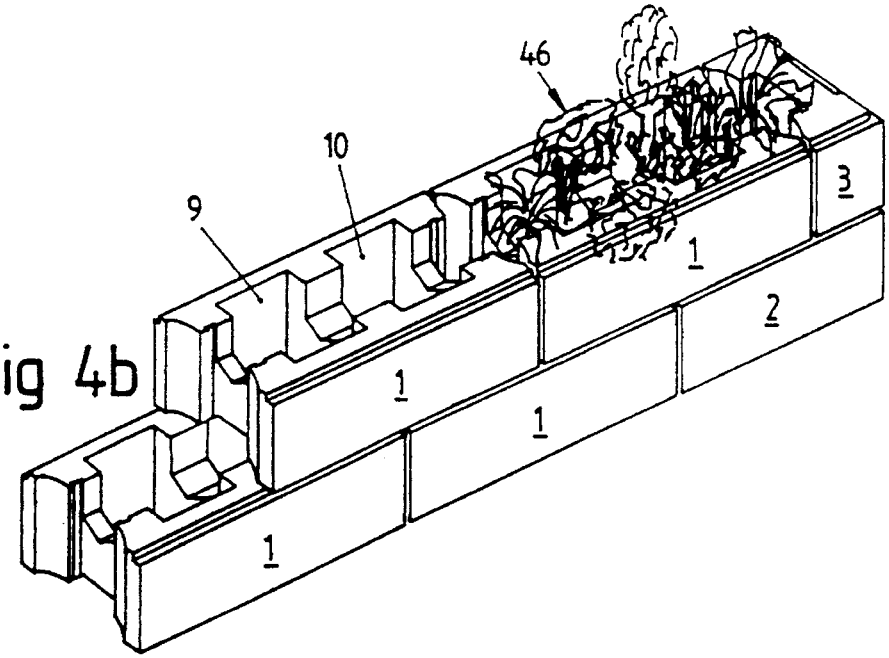
FIG. 4*b* shows a perspective view of an assembly of a plurality of blocks in two courses.

The end-side masonry structure 15 continues with a wall portion 16 recessed in a U-shaped manner in end view, as is shown in the end view according to FIG. 1*d* and the perspective views according to FIGS. 4*a*, 4*b*. The wall portion 16 which is U-shaped in end view has a bottom vertical wall portion 16' which extends approximately to half the height $H_{1/2}$ and the top wall portion 16" of which is rounded off in a V-shaped manner (FIG. 1*d*) or is designed in a U-shaped manner.

The cutout portion 14" which is U-shaped in plan view and the wall portion 16 which is U-shaped in side view have a width $b_1$, where $b_1 \approx 100$ mm in the case of the exemplary embodiment.

In the region of its U-shaped cutout portion 14", the end-side masonry structure 15 may be designed with an undercut 17 provided on both sides in order, if appropriate, to produce a positively locking engagement with connecting elements. The width of this undercut 17 is designated by $b_2$.

The middle separating web 11 is constructed in the same way as the wall portion 16 which is U-shaped in end view, i.e. the separating web 11 also has a wall portion 18 which is U-shaped in end view and has a top V-shaped cutout 18" and a bottom wall portion 18'. In accordance with the end view of FIG. 1*d* corresponding to the arrow A in FIG. 1*a*, a top cutout 16", 18" thus extends over the entire length of the basic block.

In its lateral regions, the basic block 1 has wall portions 19, 20 with a wall thickness $s_1$. Furthermore there is provided a top, offset bevel 21 having a width $b_3$ and a height $h_1$ which forms a fair-face joint when the blocks are arranged one above the other. With respect to its longitudinal-symmetry plane 22 and its transverse-symmetry plane 23, the basic block 1 is symmetrically constructed.

The ¾-end block 2 represented in FIG. 1*b* is assigned to the 1/1-basic block 1. The end block 2 is likewise symmetrically constructed with respect to its longitudinal-symmetry plane 22. As can be seen from FIG. 1*b*, the end block 2 likewise has an inner chamber 24 which, on the side which is on the left in plan view, is delimited by an end-side masonry structure 15 corresponding to the two end-side end regions 15 of the 1/1-basic block 1. Consequently, a cutout 14' which is arcuate, and a cutout 14" which is U-shaped, in plan view and a wall portion 16 which is U-shaped in end view are again provided. The end view A and its design are therefore identical to those of the basic block 1.

On the right-hand sides of the ¾-end block 2 represented in FIG. 1*b*, the end block is provided with an end-side wall portion 25 which delimits the block on the end side. The designation "end block" thus serves as an expression for an end-side delimitation of a masonry structure.

In its top region, the ¾-end block, for its part, has a lateral, offset bevel 21 which—when blocks 1 and 2 are assembled—produces a continuing fair-face joint. On the end side wall portion 25 of the end block 2, a bevel 21' runs inward in a plinth-like manner 21" in plan view.

The 1/1-basic block 1 and the ¾-end block 2 are further assigned the ¼-end block 3 which is represented in FIG. 1*c*, has a length ¼ L and likewise serves as an end-side delimitation of a row of blocks, as does the ¾-end block 2. Consequently, the end-side wall portion 25 represented on the left-hand side in FIG. 1*c* is constructed in the same way as the corresponding end-side wall portion of the ¾-end block 2 according to FIG. 1*b*. The end block 3 is merely represented such that it is turned through 180°. The lateral bevels 21 and the end-side bevel 21', 21", are likewise provided.

The opposite end side 26 of the ¼-end block 3 is designed, in its opening cross section, in the same way as the cutout portions 14', 14", which are respectively arcuate and U-shaped in plan view, of the previously described blocks 1, 2. It is only the following wall portion 16 which is not provided in the case of the ¼-end block 3. The U-shaped cutout portion 14" is followed by the wall portion 25 of the ¼-end block 3.

FIG. 1*e* shows an additional longitudinally symmetrical and transversely symmetrical supplementary block as ½-middle block 4, the length of which is ½ L. On both end sides, said block has the same geometry as the 1/1-basic block 1. The inner chamber is designated by the reference numeral 27.

The block forms 1 to 4 of the set of structural elements may have, in their respective four corner regions 28, vertically running bevels (not shown in any more detail) which also serve as fair-face edges.

The block forms according to FIGS. 1*a* to 1*e* serve for the production of straight walls and for the production of angled-off portions thereof running at 90°.

In order to be able to produce angled branched-off portions, in particular in the case of slope constructions, the set of structural elements is supplemented by a hinge block 5 and a round block 6, as are represented in more detail in FIG. 2.

The hinge block 5 and the round block 6 form two hinge parts which supplement each other and have a vertical axis of rotation 29.

The hinge part 5 has a left-hand portion or rectilinear portion 30 with a length ½ L, corresponding to half of the basic block 1 (to the left of the transverse-symmetry plane 23 in FIG. 1). The right-hand portion or cylindrical portion 31 of the hinge part 5 is formed by a circle-portion-like bollard or outer contour with a circle angle of $\alpha \approx 260°$ and a length of ½ L+X. A circle segment 32 of height "X" is the part which projects into the arcuate portion 14', i.e. into the circle-segment portion 32' of the blocks 1, 2, 3, 4. Consequently, the overall length $L_{ges}$ of the hinge part 5 is $L_{ges}=L+X$, i.e. the effective length of the hinge part 5 is of the module-dimension length "L" since the end-side segment part 32 is always held in the cutout portion 14' (segment 32') of the connection part. The same applies in the longitudinal and transverse directions of the hinge block 5 and for each intermediate angle β (see FIG. 6). Corresponding segment portions 32 in the longitudinal and transverse directions are drawn in FIG. 2*a*. The connection region of the neighboring blocks extends over an angle range of 180°. The diameter D of the circle portion 31 is thus D=2R=B+2X, the projecting circle segments 32 being held in the neighboring block in each case.

Figures 2A, 2B, 2C, 2D, 2E:
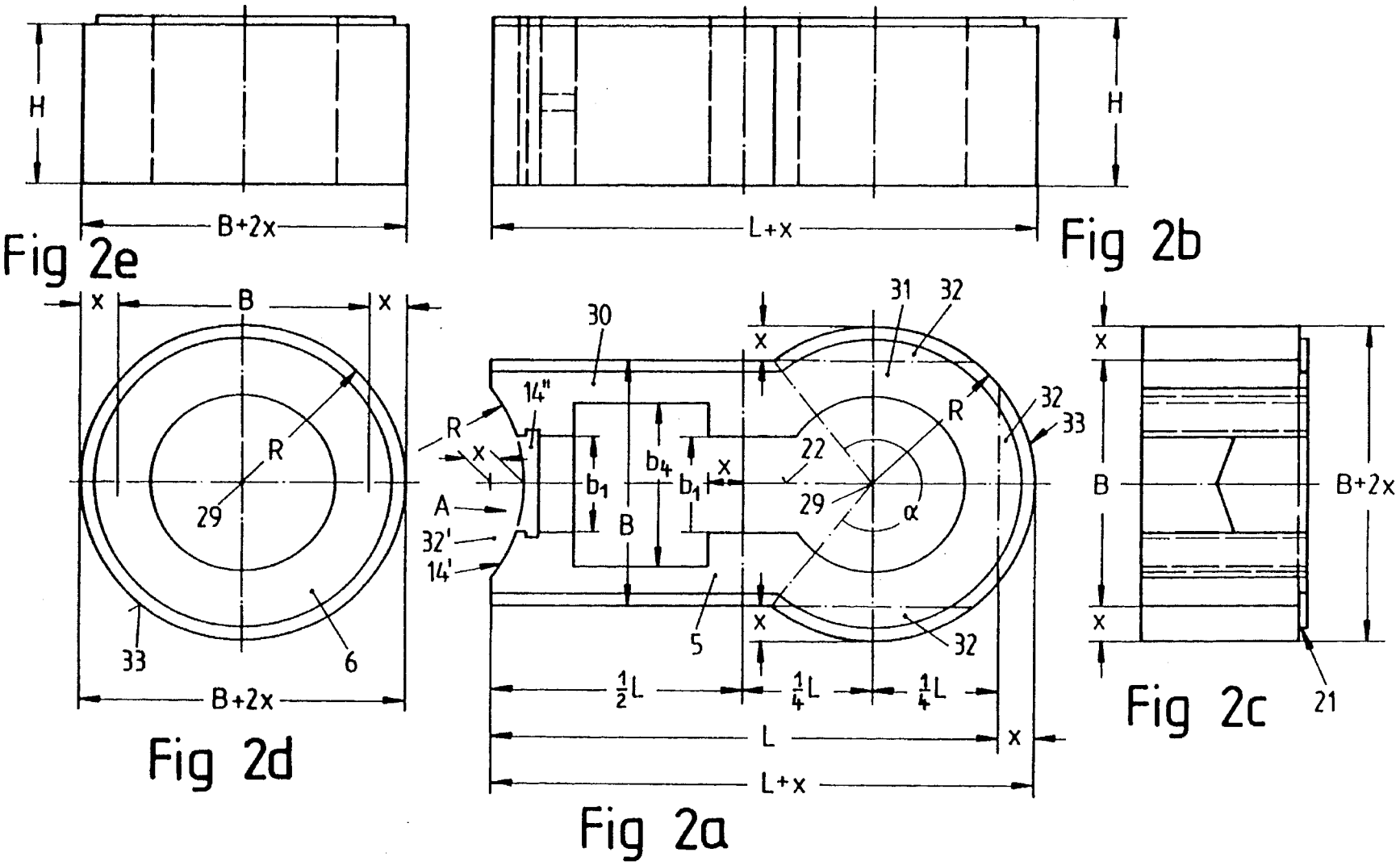
FIG. 2*a* shows a top plan view of a hinge block.
FIG. 2*b* shows a side elevational view of the hinge block.
FIG. 2*c* shows an end view of the hinge block of FIG. 2*b;*
FIG. 2*d* shows a top plan view of a round block.
FIG. 2*e* shows a side elevational view of the round block of FIG. 2*d;*

FIG. 2*b* shows the side view of the hinge block 5 and FIG. 2*c* shows the end view in direction A in FIG. 2*a*.

The round block 6 in FIG. 2*d* (plan view) and FIG. 2*e* (side view) corresponds, in its dimensions, to a complete cylinder of the circle part 31. It can be fitted together, for example, with the ½-block 4 to form a structural part which coincides with the hinge block 5.

The set of construction blocks according to FIG. 1 and, in particular, according to FIGS. 1*a* to 1*c* is reproduced in two different corner configurations in FIGS. 3*a* and 3*b*. The two corner configurations shown constitute block arrangements which could be used for every second block course in order always to obtain an overlapping of the blocks both in the corner region and in the subsequent block courses. The top horizontal row shown in FIG. 3*a* thus begins with a ¼-end block 3 which is adjoined by a 1/1-basic block 1 and a further ¼-end block 3. In FIG. 3*a*, the corner configuration shown in plan view and having the downwardly directed row is begun, in turn, with a ¼-end block 3 which is adjoined by a ¾-end block 2. Both rows may then be continued by means of 1/1-basic blocks as required.

An overlapping of the abutting edges and thus also a strengthening of the masonry structure is obtained by the next course which is shown in FIG. 3*b* and is laid, in the corner region, on the course shown in FIG. 3*a*. The corner configuration shown in plan view begins, in turn, with a ¼-end block 3 and continues, as seen going downwards in FIG. 3*b*, with a 1/1-basic block 1 and a further ¼-end block. In the horizontal direction, a ¼-end block 3 and a subsequent ¾-end block 2 are provided. The width of the respective blocks is specified by B. By superimposing FIGS. 3*a* and 3*b*, the overlapping of the individual blocks and thus also of the successive rows can be seen.

FIGS. 3*c* and 3*d* show a corresponding corner configuration with hinge blocks 5 and round block 6 and connection blocks 2 (FIG. 3*c*) and 3 (FIG. 3*d*). An overlapping of the respective abutting edges also takes place here. The circle segment 32 having the chord height "X" of the blocks 5, 6 being held in the respectively neighboring block can be seen clearly from FIGS. 3*c* and 3*d*.

Figure 5A:
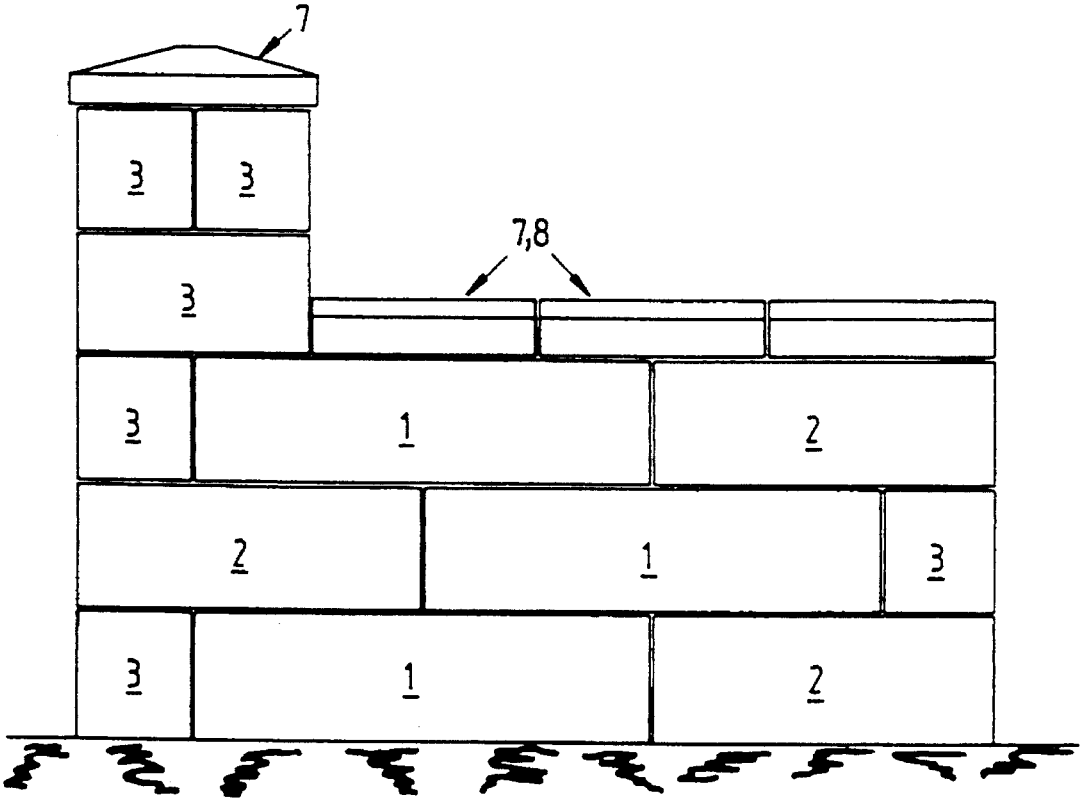
FIG. 5*a* shows a side elevational view of a masonry structure with end regions and coverings.
Figure 5B:
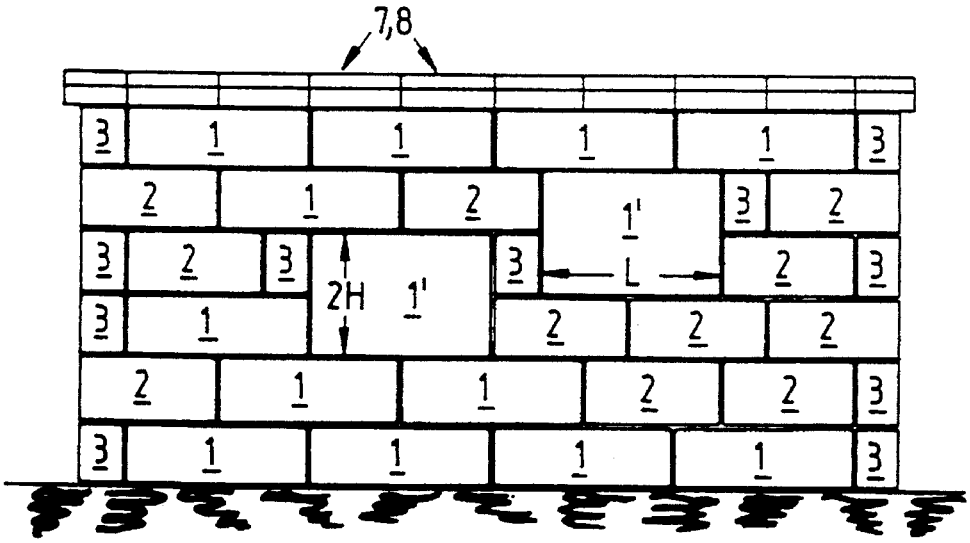
FIG. 5*b* shows a side elevational view of an alternative masonry structure.

The continued overlapping of the block forms by using the set of structural elements according to the invention is obtained in the case of planar walls from the representations according to FIGS. 5*a* and 5*b*. In these figures, the respective blocks are represented by the reference numerals 1 to 3. If the lowermost row in FIG. 5*a* begins with a ¼-end block 3 and is continued by a normal block or basic block 1, then this row can end with a ¾-end block 2. The same length is achieved in the next row up by means of a beginning ¾-end block 2, a subsequent 1/1-basic block 1 and a further ¼-end block 3. The third row, lying thereabove, begins with a ¼-end block 3, is continued with a 1/1-basic block 1 and ends, in turn, with a ¾-end block 2, corresponding to the lowermost row. The top tower on the left in FIG. 5*a* is constructed only with ¼-end blocks 3 which are each turned through 90°.

The end regions of a wall are always formed by the end blocks 2 and 3 on account of their end-side delimitation. FIG. 5*b* shows a block arrangement which comprises a plurality of blocks in the respective rows. The respective block sizes are designated by reference numerals 1 to 3. As can also be seen from FIG. 5*b*, each block row begins either with a ¾-end block 2 or a ¼-end block 3 in order to form an end termination. The basic or normal block 1 with its two open ends can only be used as middle block. FIG. 5*b* further shows a double normal block 1', which has the same geometric configuration as the 1/1-basic block 1, but the height H of which is merely twice the size. It thus covers two rows.

FIGS. 4*a* and 4*b* show the different block forms in perspective view. In particular, FIG. 4*a* shows a bottom block course comprising two basic blocks 1 which are arranged one beside the other and have a further basic block 1 positioned centrally thereon. For a positively locking connection of these blocks lying one above the other there may be provided an additional connecting block 45 which, in terms of its dimensions, is adapted to the end-side U-shaped cutouts 14" of the individual block forms and the middle cutout 18". The width $b_1$ is, for example, 100 mm, the length $l_3 \approx 80$ mm and the height $h_2 \approx 100$ mm. The connecting block or filler block 45 is introduced, in accordance with the representation in FIG. 4*a*, into the middle, U-shaped cutout 18" of the right-hand bottom basic block 1 and projects beyond the bottom block 1 with half of its height. The connecting block 45 projects, by said height ½ $h_2$, into the outer, end-side cutout 14 of the basic block 1 lying thereabove and thus forms a positively locking connection in the portion 14". As is shown in the case of the bottom, right-hand block 1, the connection to the next block in the same row takes place in the same manner, the connecting block 45 then engaging into the end-side cutouts 14. The individual block forms are accordingly connected in a positively locking manner in the horizontal and vertical directions by means of the connecting block.

Of course, the connecting block 45 may also be of a shape which is other than cuboidal. In particular, it may have protrusions which engage in a positively locking manner behind corresponding cutouts on the block. Normally, however, this is not necessary.

In the drawing shown in FIG. 4*b*, the set of masonry blocks with its chambers 9, 10 is designed as a retaining wall. Consequently, all the chambers of the block forms can be filled with earth and cultivated with plants 46.

Figure 6A:
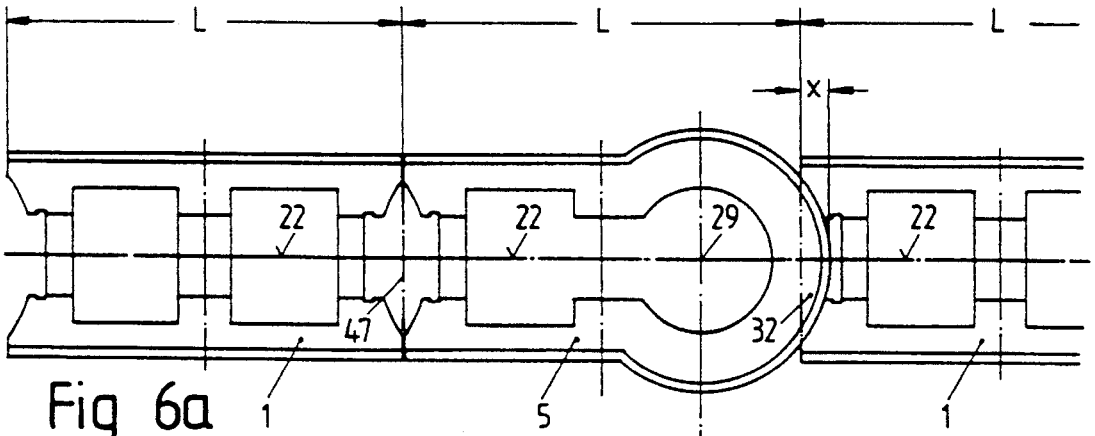
FIGS. 6*a* and 6*b* show a plan view of a multi-course hinge-block arrangement.
Figure 6B:
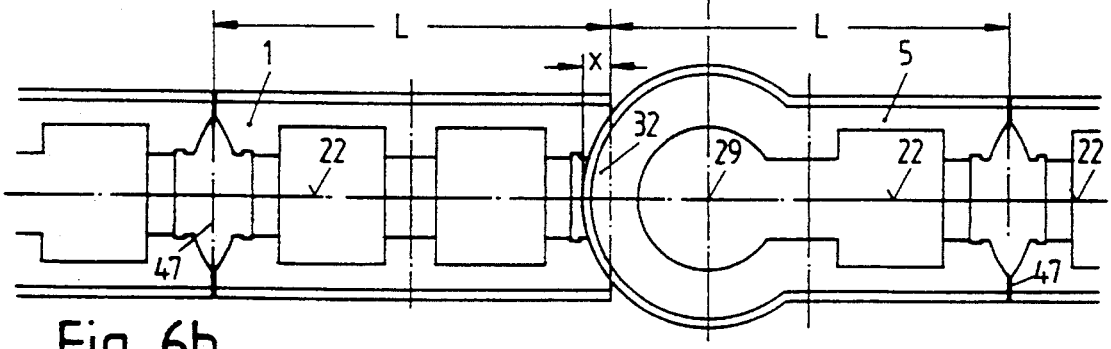

FIGS. 6i ato 6*h* show a further use of the hinge block 5 and of the round block 6. FIGS. 6*a* and 6*b* show a plan view of a rectilinear hinge-block configuration, said two configurations being laid one upon the other to bridge joints. Generally, the hinge block 5 is described in great detail in FIG. 2. Reference is once again made to the configurations found there. Like parts are provided with like reference numerals.

Figure 6C:
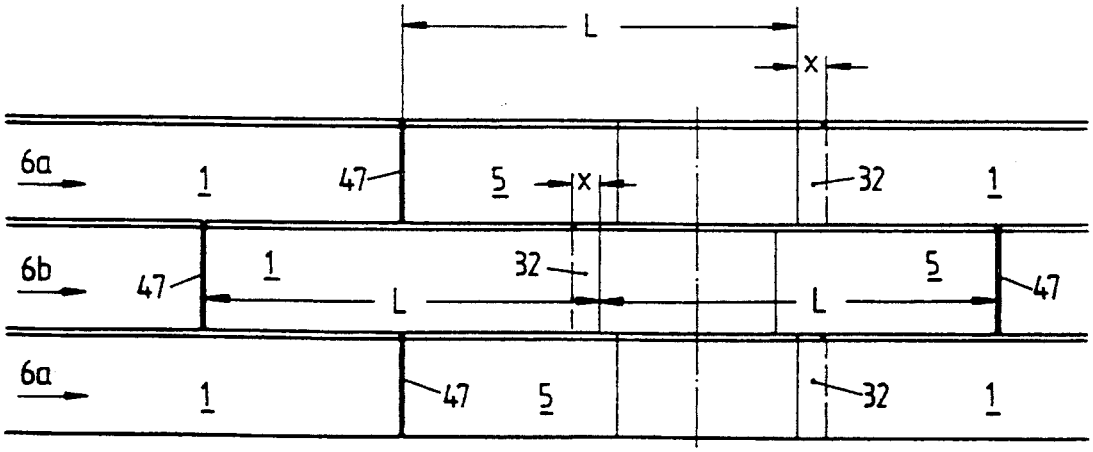
FIGS. 6*c* shows a side elevational view of the arrangement of FIGS. 6*a* and 6*b;*

Starting from the axis of rotation 29 in the plan view of FIG. 6*a* and in the side view of FIG. 6*c*, a rectilinear or elongate arrangement of the hinge block 5 is obtained, the arrangement in FIG. 6*a* showing the top and bottom block row and the arrangement according to FIG. 6*b* showing the middle block row, lying therebetween, in FIG. 6*c*. The respective hinge blocks 5 and the connection blocks, e.g. base block 1, are specified in the drawing for producing a joint offset (joints 47).

Figure 6D:
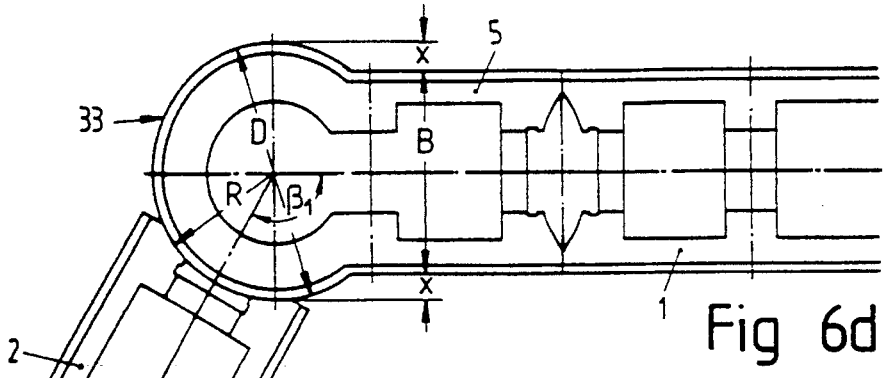
FIGS. 6*d* to 6*h* show variants of the arrangement shown in FIGS. 6*a* and 6*b.

The representations of a plurality of hinge blocks 5 in different angle positions is shown in FIGS. 6*d* to 6*h*. FIG. 6*d* shows an angled arrangement with an enclosed angle of, for example, $\beta_1=120°$. For this, the cylinder lateral surface 33 of the hinge block 5 can serve as "hinge surface" which interacts with the arcuate cutout 14' of each connection block, in this case with the ¾-end block 2. The radius "R" of the cylindrical lateral surface 33 of the hinge block 5 thus corresponds to the radius R of the arcuate portion 14' In the same way, the chord height "X", i.e. the depth of penetration of the portion 14' into the respective connection block 1, 2, 3, 4, is adapted to the amount "X" by which the cylinder lateral surface 33 projects with respect to the normal block width B, i.e. diameter D=2R=B+2X. This design allows the respective connection part to be pivoted by up to 90° from the elongate course (FIG. 6) in both directions, i.e. 180° in total.

Figure 6E:
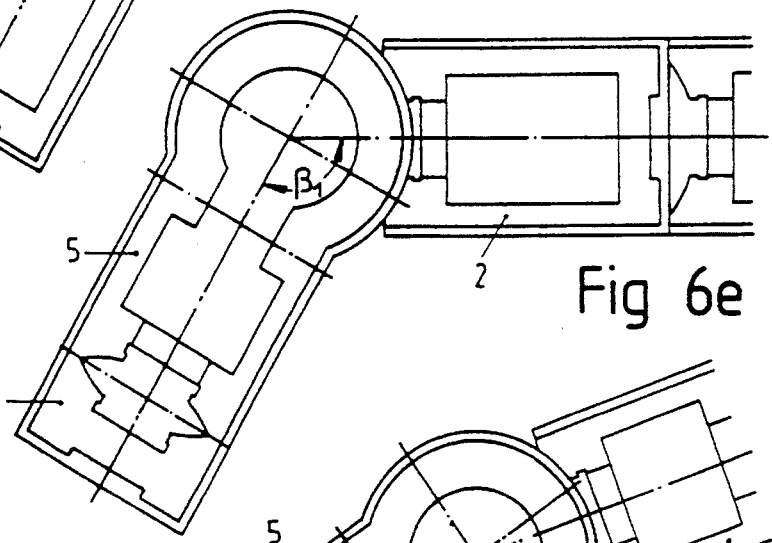
Figure 6F:
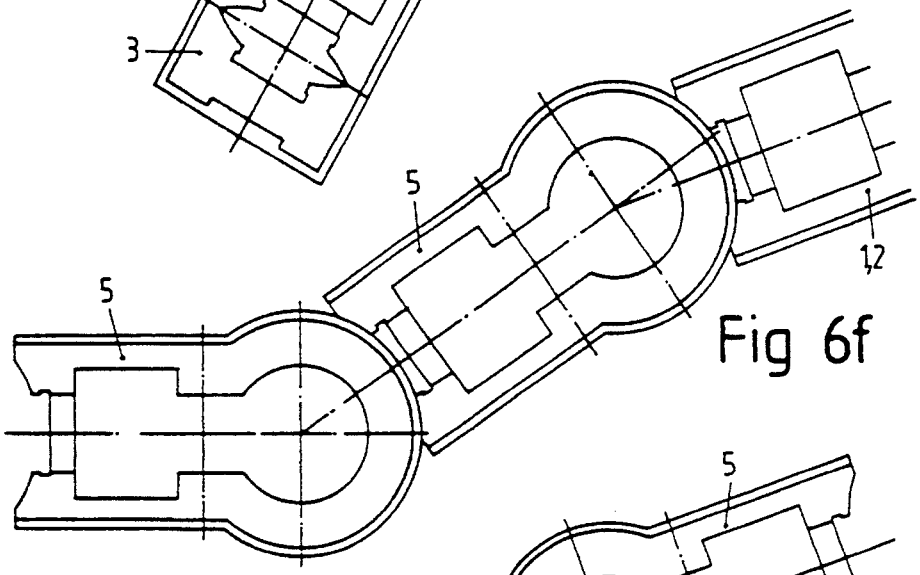
Figure 6G:
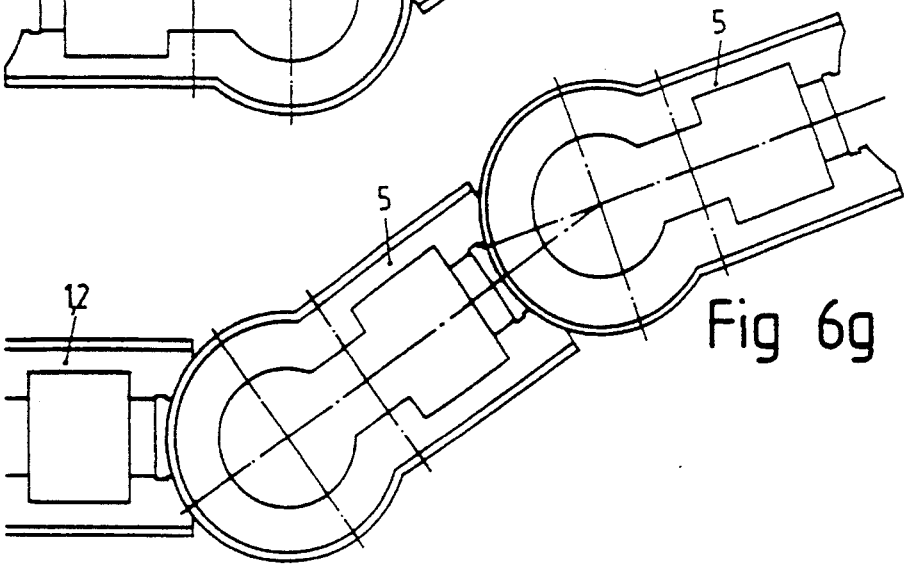
Figure 6H:
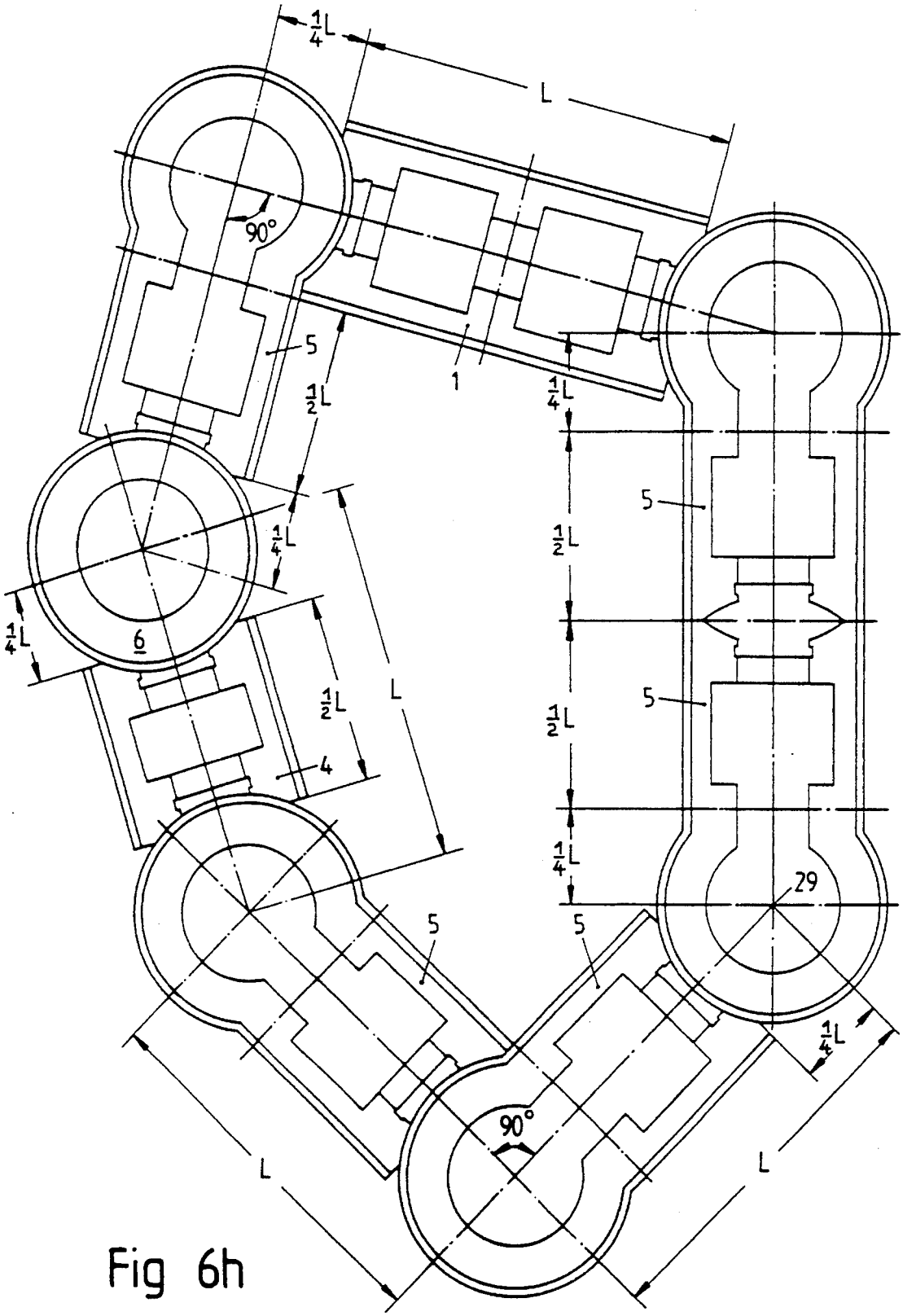

FIG. 6*d* thus shows the hinge part 5 in upper longitudinal arrangement and FIG. 6*e* shows the hinge part 5 in angled-off position. The arrangements according to FIGS. 6*d* and 6*e* could thus be arranged one above the other in order to achieve a joint offset. FIGS. 6*f* and 6*g* show a two-fold angling-off by means of two hinge blocks 5 positioned one behind the other. These double-angled arrangements can likewise be stacked one above the other for the purpose of a joint offset. Finally, FIG. 6*h* shows a closed circle with various hinge blocks and connection blocks connected one behind the other in various angle arrangements. The diverse combination of the various block forms can be seen from this.

Figure 7A:
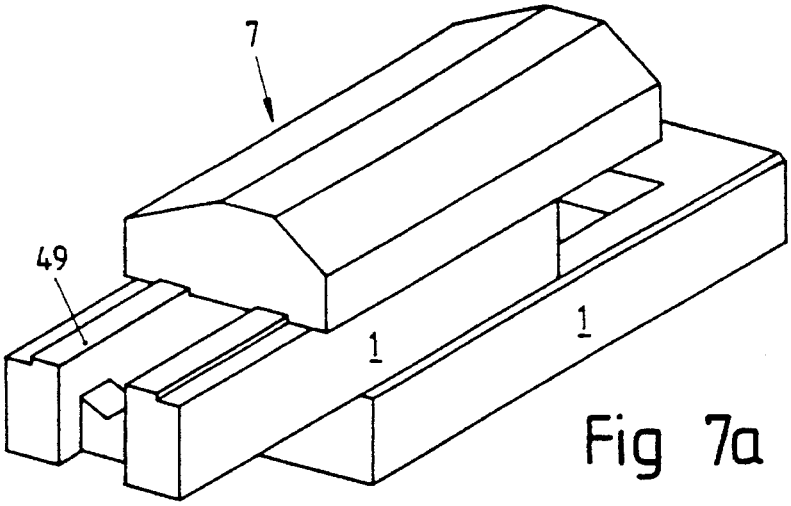
* and FIGS. 7*a* to 7*c* show various covering blocks and coping stones.
Figure 7B:
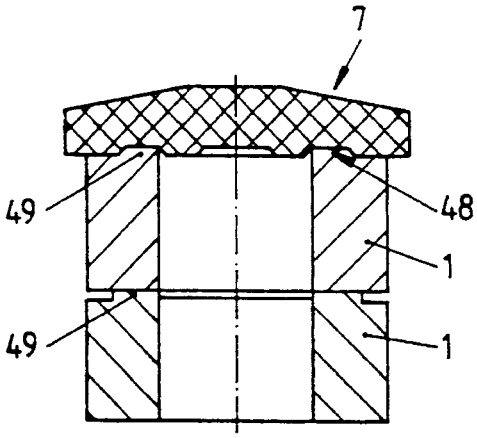

FIGS. 5*a*, 5*b* and 7*a* to 7*c* show various covering blocks or covering-block variants. FIG. 7*a* thus shows, in purely schematic representation, a roof-shaped covering block 7, having oblique upper surfaces, on a 1/1-basic block 1. A section through the arrangement according to FIG. 7*a* is shown in FIG. 7*b*. It can be seen from this that the covering block 7 may have, on its underside, elongate, cross sectionally U-shaped cutouts 48 which can form positively locking connections with elevations 49, which may be provided, on the upper side of the basic blocks 1. Said elevations 49 can be provided by a corresponding machining of the upper side of all block forms. In the same way, there may be provided, on the underside of each block form, a corresponding, appertaining cutout for a positively locking connection.

Figure 7C:
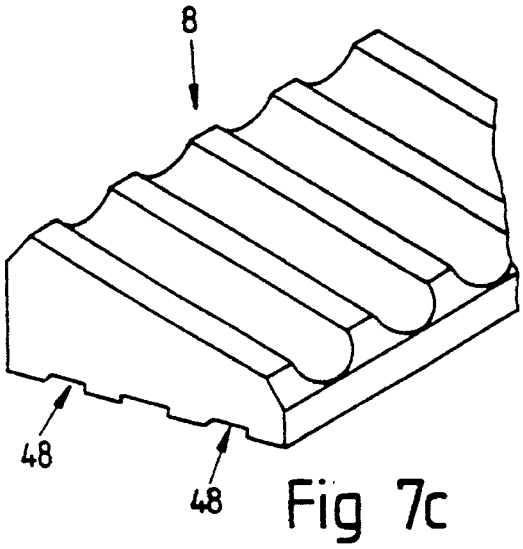

FIG. 7*c* shows a further variant of a covering block 8 which is designed in a similar manner to a corrugated metal roof. This covering block 8 also has, on its underside, cutouts 48 which serve for a positively locking engagement with corresponding webs 49.

Each masonry structure can accordingly be covered by corresponding covering blocks 7, 8. This is shown schematically in FIGS. 5*a* and 5*b*.

The invention is not restricted to the exemplary embodiment which has been shown and described. Rather, it also comprises all specialist developments within the context of the idea of the invention. Consequently, the masonry block according to the invention may be designed in various dimensions as fired clay brick, as a conventionally dried cement brick, as a sand-lime brick, which has, for example, been steam-cured, or the like with and without bevels. Different blocks may also, of course, be connected by providing the blocks with mortar, with the result that the filler block may, if appropriate, be dispensed with. As a result, universal application of the set of masonry blocks according to the invention is possible.

I claim:

1. A set of masonry blocks, comprising:

a rectangular basic block having a basic length dimension L, a width B and a height H and including lateral end sides comprising a joining portion extending over the entire height H of the basic block, the joining portion including a recess defining a portion of a first cylinder having a first radius, the joining portion being adapted to contact adjacent masonry blocks at matching joining portions thereof;

rectangular end blocks having first and second lateral end sides, the first lateral end side comprising a joining portion having a structure identical to the joining portion of the basic block, the second lateral end side comprising a closed masonry-wall termination surface, the rectangular end blocks including:

a three quarter end block having a length equal to three quarters of the basic length dimension L; and a one quarter end block having a length equal to one quarter of the basic length dimension L;

a hinge block having a length equal to the basic length dimension L plus an extension amount X, the hinge block further having a rectilinear portion and a cylindrical portion attached to the rectilinear portion, the rectilinear portion including a joining portion having a structure identical to the joining portion of the basic block, the cylindrical portion including an outer contour defining a portion of a second cylinder having a second radius R equal to the first radius and adapted to mate with a corresponding recess of an adjacent joining portion in an assembled state wherein the first and second cylinders have corresponding center points, wherein 2R=B+2X, the outer contour of the cylindrical portion thereby extending beyond the width B of each masonry block on each side thereof by an amount equal to the extension amount X.

2. The set of masonry blocks according to claim 1, and further including a one-half block having a length equal to one half of the basic length dimension L, the one-half block having lateral end sides, each of the lateral end sides of the one-half block comprising a joining portion having a structure identical to the joining portion of the basic block, the one-half block further having an inner cavity therein.

3. The set of masonry blocks according to claim 1, and further including a round block defining a third cylinder having a third radius equal to the first radius.

4. The set of masonry blocks according to claim 1, wherein the masonry blocks have a width equal to one half of the basic length dimension L.

5. The set of masonry blocks according to claim 4, wherein the width of the masonry blocks is equal to about 30 cm.

6. The set of masonry blocks according to claim 1, wherein the masonry blocks have a height equal to one quarter of the basic length dimension L.

7. The set of masonry blocks according to claim 6, wherein the height of the masonry blocks is equal to about 15 cm.

8. The set of masonry blocks according to claim 1, wherein the joining portion of each of the basic block, the end blocks, and the hinge block includes a U-shaped cut-out region therein, the set of masonry blocks further including a positively-locking connecting block adapted to be positioned in respective joining portions of adjacent blocks.

9. The set of masonry blocks according to claim 1, the set of masonry blocks further including a positively locking connecting block, wherein the basic block includes two chambers therein and a partition wall located between the two chambers, the partition wall having, over approximately half of a height thereof, a U-shaped cut-out for receiving the connecting block.

10. The set of masonry blocks according to claim 1, wherein the masonry blocks are made of a material selected from the group consisting of clay, cement, and sand-lime.

* * * * *